US007762650B2

(12) United States Patent
Miura et al.

(10) Patent No.: US 7,762,650 B2
(45) **Date of Patent: *Jul. 27, 2010**

(54) METHOD OF MANUFACTURING INK JET HEAD AND INK JET HEAD

(75) Inventors: Hirotsuna Miura, Fujimi-machi (JP); Nobuko Watanabe, Kanazawa (JP); Jun Amako, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

This patent is subject to a terminal disclaimer.

(21) Appl. No.: 11/594,942

(22) Filed: Nov. 9, 2006

(65) Prior Publication Data

US 2007/0052754 A1 Mar. 8, 2007

Related U.S. Application Data

(62) Division of application No. 10/852,455, filed on May 25, 2004, now Pat. No. 7,169,537.

(30) Foreign Application Priority Data

Jun. 17, 2003 (JP) ..... 2003-172152

(51) Int. Cl.
*B41J 2/14* (2006.01)
*B41J 2/135* (2006.01)

(52) U.S. Cl. ..... 347/47; 347/45

(58) Field of Classification Search ..... 347/45, 347/47

See application file for complete search history.

(56) References Cited

U.S. PATENT DOCUMENTS 5,798,778 A 8/1998 Kimura et al.
5,949,454 A 9/1999 Nozawa et al.
6,102,521 A * 8/2000 Halko et al. ..... 347/47
6,336,697 B1 1/2002 Fukushima
6,484,399 B2 11/2002 Aono et al.
7,267,427 B2 * 9/2007 Miura et al. ..... 347/47
7,305,868 B2 * 12/2007 Asuke et al. ..... 73/64.55

FOREIGN PATENT DOCUMENTS

| | | |
|---|---|---|
| CN | 1255892 A | 6/2000 |
| JP | A 04-294145 | 10/1992 |
| JP | A-06-210859 | 8/1994 |
| JP | A-08-039805 | 2/1996 |
| JP | A-9-300611 | 11/1997 |
| JP | A 11-268264 | 10/1999 |
| JP | A 2000-290556 | 10/2000 |
| JP | A 2003-072085 | 3/2003 |
| WO | WO 99/38694 | 8/1999 |

* cited by examiner

*Primary Examiner*—An H Do
(74) *Attorney, Agent, or Firm*—Oliff & Berridge, PLC

(57) ABSTRACT

To provide an ink jet head having a good stability of ejection and a method of manufacturing the ink jet head, a method of manufacturing an ink jet head that includes a cavity and a nozzle connected to the cavity and ejects fluid contained in the cavity from an ejection opening that is an opening provided on a side of the nozzle opposite to the cavity An inside-nozzle lyophobic film is formed in the vicinity of the ejection opening and on the inside wall of the nozzle, the inside-nozzle lyophobic film providing a large difference between an advancing contact angle and a receding contact angle for the liquid to be ejected.

5 Claims, 4 Drawing Sheets

METHOD OF MANUFACTURING INK JET HEAD AND INK JET HEAD

This is a Divisional of application Ser. No. 10/852,455 filed May 25, 2004, now U.S. Pat. No. 7,169,537, which claims the benefit of Japanese Patent Application No. JP 2003172152 filed Jun. 17, 2003. The entire disclosures of the prior applications are hereby incorporated by reference herein in their entirety.

BACKGROUND OF THE INVENTION

1. Field of Invention

The present invention relates to a method of manufacturing an ink jet head and an ink jet head used for the ink-jet method to eject droplets.

2. Description of Related Art

As a method capable of depositing a predetermined amount of liquid materials on required positions, a related art droplet ejection method exists. The ink-jet method is one of these droplet ejection methods and particularly suitable to eject a minute amount of liquid materials.

An ink jet head used for the ink-jet method includes a cavity to contain liquid and a nozzle plate provided with a nozzle connected to the cavity, and composed so as to eject the liquid contained in the cavity from an ejection opening that is an opening provided on a side opposite to the cavity.

In such an ink jet head, the contacting properties with the liquid particularly in the vicinity of the ejection opening, specifically whether it is lyophobic or lyophilic is an important factor to stably eject a droplet of the liquid.

From a viewpoint of the above, in the related art a eutectoid plate is provided on the ejection opening side surface of the nozzle plate to provide lyophobicity to the ejection opening side of the surface and an area in the vicinity of the ejection opening inside the nozzle (See Japanese Unexamined Patent Publication No. 4-294145).

Further, as a related art technology focusing attention to whether it is lyophobic or lyophilic, a lyophobic film is formed on the ejection opening side surface of the nozzle plate, and liquid having a receding contact angle for the membrane having lyophobicity of not less than 15 degrees is used to be ejected (See Japanese Unexamined Patent Publication No. 2000-290556).

SUMMARY OF THE INVENTION

Both of the above technologies, the technology of providing the eutectoid plate and the technology focusing on the receding dynamic contact angle for the membrane with lyophobicity, intend to prevent the front surface of the nozzle plate, specifically, the ejection opening forming side surface of the nozzle plate from being wetted by the liquid thereby preventing the succeeding droplet from being ejected unstably due to the wetted front surface of the nozzle plate.

However, in view of the stable ejection of the droplet, especially of stabilization of the ejection amount, the consideration only of the wettability (lyophobicity and lyophilicity) of the ejection opening forming side surface of the nozzle plate is not sufficient.

The present invention intends to address the above circumstance and provides an ink jet head that stably ejects droplets and a method of manufacturing the ink jet head.

To address with the above problem, the inventors of the present invention devoted themselves to research and development to find out the following knowledge.

In the period from ejection of a droplet to ejection of the succeeding droplet, the liquid contained in the cavity and the nozzle typically forms a meniscus. Specifically, the liquid is maintained so that the edge of the meniscus is positioned inside the nozzle to prepare for the next ejection. Therefore, if the position of the meniscus in the nozzle is constant in every ejection, the ejection amount can be stabilized enabling more stabilized ejection.

After further research and development based on the above knowledge, the present invention has been completed.

Specifically, a method of manufacturing an ink jet head according to an aspect of the present invention is a method of manufacturing an ink jet head that includes: a cavity and a nozzle connected to the cavity and ejects fluid contained in the cavity from an ejection opening that is an opening provided on a side of the nozzle opposite to the cavity; and forming an inside-nozzle lyophobic film in the vicinity of the ejection opening and on the inside wall of the nozzle, the inside-nozzle lyophobic film providing a large difference between an advancing contact angle and a receding contact angle for the liquid to be ejected.

According to the above method of manufacturing an ink jet head, since the inside-nozzle lyophobic film providing a large difference between an advancing contact angle and a receding contact angle for the liquid to be ejected is formed, the resulting ink jet head expresses sufficient stability of ejection. Specifically, when the edge of the meniscus of the liquid moves on the inside-nozzle lyophobic film, since the difference between an advancing contact angle and a receding contact angle for the liquid, the edge of the meniscus easily remains at a predetermined position (an initial position) in comparison with the case in which the difference is small. Therefore, the stabilization of the ejection amount can be achieved by maintaining the position of the meniscus edge constant through every ejection.

Furthermore, in the method of manufacturing an ink jet head, the nozzle may be formed on a nozzle plate, and forming a lyophobic film in the vicinity of the ejection opening and on the inside wall of the nozzle, and changing the lyophobicity of the lyophobic film by applying energy to a part of the lyophobic film to form the inside-nozzle lyophobic film may be provided.

Thus, by forming the inside-nozzle lyophobic film with changed lyophobicity, the difference between an advancing contact angle and a receding contact angle can be enlarged.

Furthermore, in the method of manufacturing an ink jet head, the nozzle may be formed on a nozzle plate, and forming a lyophobic film in the vicinity of the ejection opening and on the inside wall of the nozzle, and changing the lyophobicity of the lyophobic film by applying energy distribution to a part of the lyophobic film to form the inside-nozzle lyophobic film may be provided.

Thus, by forming the inside-nozzle lyophobic film with changed lyophobicity, the difference between an advancing contact angle and a receding contact angle can be enlarged.

Further, in the method of manufacturing an ink jet head, the energy may be light energy, and interference of coherent light is may be used as the energy distribution.

Being thus configured, the energy or the energy distribution can more effectively be applied to the lyophobic film.

Still further, in the method of manufacturing an ink jet head, silicone resin may be used as the lyophobic film, and in this case, the lyophobic film may be a plasma-polymerized film formed on the ejection opening side of the nozzle plate by plasma-polymerizing the silicone resin. In this case, the change in the lyophobicity may be caused by irradiating the lyophobic film with ultra violet light.

Thus, the change in the lyophobicity of the lyophobic film can efficiently be carried out.

Furthermore, in the method of manufacturing an ink jet head, changing the lyophobicity of the lyophobic film to form the inside-nozzle lyophobic film may include forming the inside-nozzle lyophobic film by providing a reflecting mirror so as to cover the ejection opening, and irradiating inside the nozzle with a ultra violet laser beam from an opposite side of the ejection opening under an oxygen environment to expose the lyophobic film to an interference pattern caused by an incoming beam of the ultra violet laser beam and a reflected beam thereof reflected by the reflecting mirror.

According to this, since the plasma-polymerized film is exposed to an interference pattern caused by an incoming beam of the ultra violet laser beam and a reflected beam thereof reflected by the reflecting mirror, exposed sections and unexposed sections are formed on the obtained inside-nozzle lyophobic film corresponding to the interference pattern. Accordingly, the exposed sections become lyophilic sections by application of oxygen while the unexposed sections remain lyophobic to form the lyophobic sections. Therefore, by thus mixing the lyophobic sections and the lyophilic sections, the inside-nozzle lyophobic film can have a relatively large advancing contact angle and a relatively small receding contact angle, which can make the difference between a receding contact angle and a advancing contact angle larger.

Still further, in the method of manufacturing an ink jet head, changing the lyophobicity of the lyophobic film to form the inside-nozzle lyophobic film may include forming the inside-nozzle lyophobic film by providing a reflecting mirror with a patterned indented surface so as to cover the ejection opening, and irradiating inside the nozzle with a ultra violet laser beam from an opposite side of the ejection opening under an oxygen environment to expose the plasma-polymerized film to the ultra violet laser beam reflected by the reflecting mirror.

According to this, since the plasma-polymerized film is exposed to the beam reflected by the reflecting mirror with a patterned indented surface, the resulting inside-nozzle lyophobic film is unevenly exposed to the beam resulting in strongly exposed sections and weakly exposed sections on the inside-nozzle lyophobic film. Accordingly, the strongly exposed sections become lyophilic sections including a large number of lyophilic portions applied with lyophilicity by application of oxygen while the weakly exposed sections become lyophobic sections including the lyophilic portions a little. Therefore, by thus mixing the lyophobic sections and the lyophilic sections, the inside-nozzle lyophobic film can have a relatively large advancing contact angle and a relatively small receding contact angle, which can make the difference between a receding contact angle and a advancing contact angle larger.

Furthermore, in the method of manufacturing an ink jet head, changing the lyophobicity of the lyophobic film to form the inside-nozzle lyophobic film may include forming the inside-nozzle lyophobic film by irradiating inside the nozzle with a ultra short pulsed laser beam from an opposite side of the ejection opening under an oxygen environment to expose the plasma-polymerized film to the ultra short pulsed laser beam.

According to this method, since the plasma-polymerized film is exposed to the ultra short pulsed laser beam, the resulted inside-nozzle lyophobic film is unevenly exposed because the exposure is executed momentary with large energy, resulting in strongly exposed sections and weakly exposed sections on the inside-nozzle lyophobic film. Therefore, as described above, the lyophobic sections and the lyophilic sections are mixedly provided. Accordingly, the inside-nozzle lyophobic film can have a relatively large advancing contact angle and a relatively small receding contact angle, which can make the difference between a receding contact angle and a advancing contact angle larger.

Still further, in the method of manufacturing an ink jet head, when the laser beam irradiates inside the nozzle, a condenser may be provided between a source of the laser beam and the nozzle to condense the laser beam inside the nozzle.

According to the above, by condensing the laser beam inside the nozzle by the condenser, the exposure efficiency can be enhanced to, for example, shorten the exposure time or to increase the exposure value.

An ink jet head according to an aspect of the present invention includes an inside-nozzle lyophobic film formed in the vicinity of the ejection opening and on the inside wall of the nozzle, the inside-nozzle lyophobic film providing a large difference between an advancing contact angle and a receding contact angle for the liquid to be ejected.

According to this ink jet head, since the difference between an advancing contact angle and a receding contact angle is enlarged, the stable ejection can be realized by the inside-nozzle lyophobic film.

An ink jet head according to an aspect of the present invention includes a lyophobic section and a lyophilic section distributed in the vicinity of the ejection opening and on the inside wall of the nozzle.

According to this ink jet head, since the lyophobic section and the lyophilic section are distributed in the vicinity of the ejection opening, the difference between an advancing contact angle and a receding contact angle is enlarged in an area including the lyophobic section and the lyophilic section. Accordingly, the stable ejection can be realized by this area.

DETAILED DESCRIPTION OF EXEMPLARY EMBODIMENTS

Hereinafter, described in detail are a method of manufacturing an ink jet head according to an aspect of the present invention and an ink jet head according to an aspect of the present invention obtained by the method.

Figure 1A:
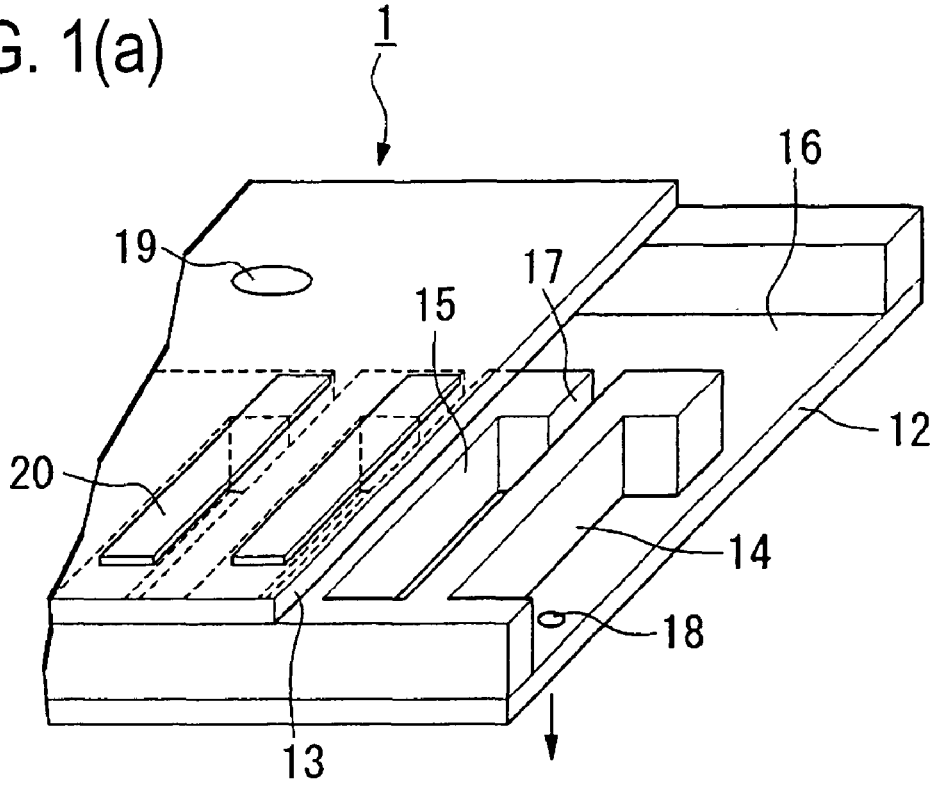
FIGS. 1(*a*) and (*b*) are schematics showing a structure of an ink jet head.
Figure 1B:
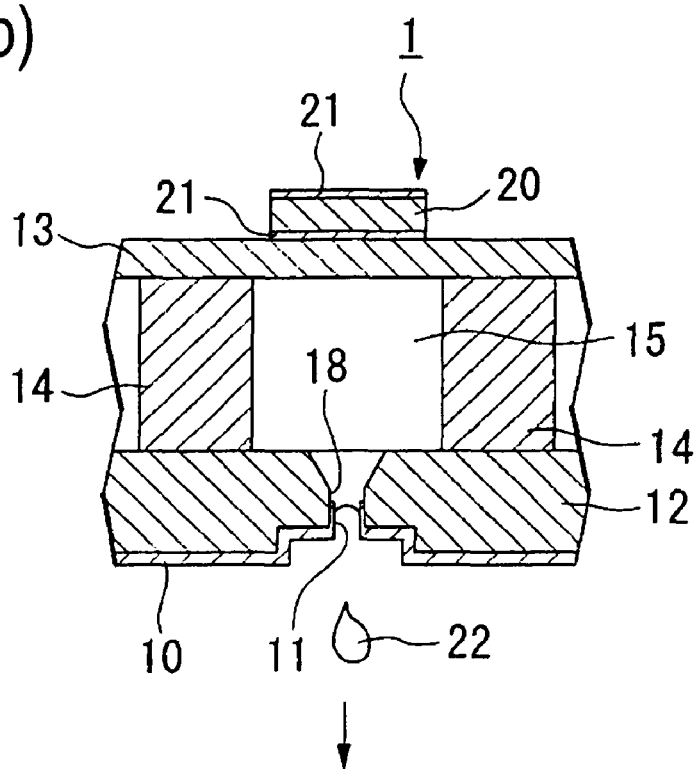

FIGS. 1(*a*) and 1(*b*) are schematics for explaining a structure of the ink jet head to which the method of manufacturing an ink jet head according to an aspect of the present invention is applied. In FIGS. 1(*a*) and 1(*b*), a reference numeral 1 denotes an ink jet head. The ink jet head is, as shown in FIG. 1(*a*), equipped with a nozzle plate 12 and a diaphragm 13 made of, for example, stainless steel, and formed by joining them via a separating member (a reservoir plate) 14. A plurality of cavities 15 and a reservoir 16 are formed between the nozzle plate 12 and the diaphragm 13 with the separating member 14, the cavities and reservoir being connected via channels 17.

Each pair of the cavity 15 and the reservoir 16 contains liquid so as to be filled up with the liquid, and the channel 17 connecting the cavity and the reservoir 16 functions as a supply port to supply the liquid from the reservoir 16 to the cavity 15. Further, a plurality of nozzles 18 which are openings to eject fluid contained in the cavity 15 are provided on the nozzle plate 12 as a matrix. The nozzle 18 has a taper shape in the cavity 15 side, and becomes gradually thicker in diameter towards the cavity 15 side. An opening provided on the opposite side to the cavity 15 is an ejection opening 9 to eject droplets. A lyophobic film 10 is provided on the surface of the nozzle plate 12 on which the ejection opening is provided. The lyophobic film 10 is formed so as to be turned into the inside wall of the nozzle 18 in the vicinity of the ejection opening 9.

An opening 19 is provided on the diaphragm 13 so as to lead to the reservoir 16, and a tank (not shown in the drawings) is connected to the opening 19 via a tube (not shown in the drawings).

Furthermore, as shown in FIG. 1(*b*), a piezoelectric element (a piezo element) 20 is bonded on a surface of the diaphragm 13 opposite to the surface thereof facing towards the cavity 15. The piezoelectric element 20 functions as an ejection device of the ink jet head 1, and is held by a pair of electrodes 21 and 22 to be projected outward in response to application of electricity thereto.

In the above structure, the diaphragm 13 bonded with the piezoelectric element 20 bends outward in a body therewith to enlarge the capacity of the cavity 15 in accordance with the piezoelectric element 20 bending. Then, since the cavity 15 and the reservoir 16 are connected to each other, if the reservoir 16 is filled with fluid, an amount of the fluid corresponding to the increment of the capacity of the cavity 15 flows into the cavity 15 from the reservoir 16 through the channel 17.

In this situation, when the application of electricity to the piezoelectric element 20 is canceled, the piezoelectric element 20 and the diaphragm 13 are restored to their initial shapes. Accordingly, since the capacity of the cavity 15 is reduced to the initial value, the pressure of the fluid contained in the cavity 15 is increased to cause a droplet 22 of the fluid to be ejected from the ejection opening 9 of the nozzle 18.

The ejection device for the ink jet head 1 is not limited to the electromechanical transducer using the piezoelectric element (the piezo element) 20. For example, a method using an electro-thermal transducer, a continuous method, such as a charge control type or a pressurized vibration type, an electrostatic absorption method, or a method of ejecting the fluid using an action caused by heat generated by irradiation of, for example, a laser beam can also be used as the ejection device.

Figure 2:
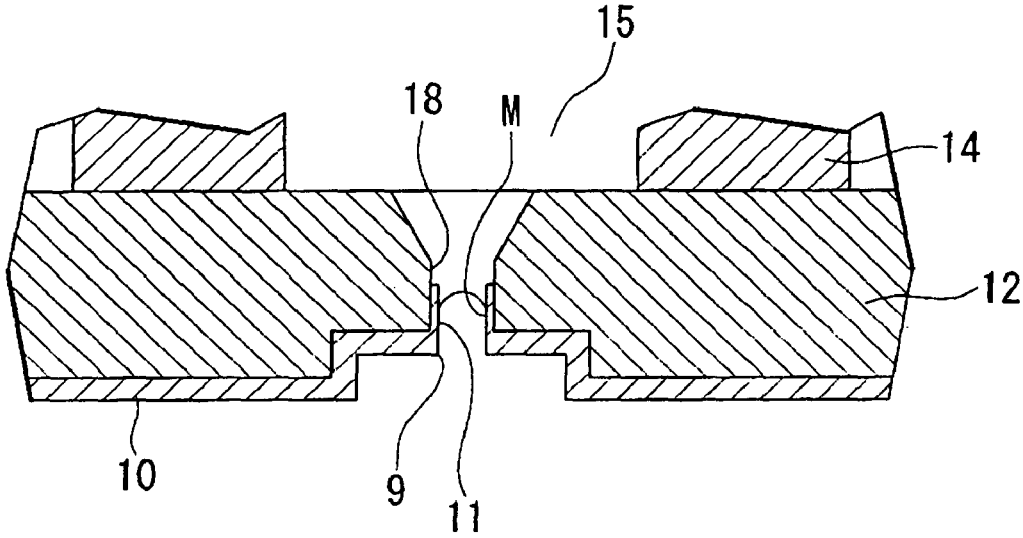
FIG. 2 is a cross-sectional schematic of a substantial part of a nozzle plate.

In the ink jet head 1 thus structured, as described above, the lyophobic film 10 is provided on a part of the nozzle plate 12 from the surface with the ejection opening 9 to the inside wall of the nozzle 18 and in the vicinity of the ejection opening 9. And, in the lyophobic film, as shown in FIG. 2, a part thereof provided on the inside wall of the nozzle 18 and in the vicinity of the ejection opening 9 is defined as a inside-nozzle lyophobic film 11. The inside-nozzle lyophobic film has a large difference between an advancing contact angle and a receding contact angle for the fluid to be ejected. Specifically, it has an advancing contact angle of not less than 50 degrees and not greater than 100 degrees and a receding contact angle of not greater than 30 degrees, providing the difference of not less than 20 degrees.

Therefore, the ink jet head 1 exercises good ejection stability owing to the inside-nozzle lyophobic film 11. Specifically, when the edge section M of a meniscus of the fluid moves on the inside-nozzle lyophobic film 11, as shown in FIG. 2, in the nozzle 18 after an ejection operation to prepare for the succeeding ejection operation, since the inside-nozzle lyophobic film 11 has a large difference between the advancing contact angle and the receding contact angle for the fluid, the edge section M of the meniscus is easier to remain in a predetermined position (an initial position) on the inside-nozzle lyophobic film 11 than with a small difference therebetween. Accordingly, the edge section M of the meniscus can be restored to substantially the same position in every ejection, thus stabling the amount of ejection.

The advancing contact angle and the receding contact angle of the inside-nozzle lyophobic film 11 (a solid sample) for the fluid (a liquid sample) to be ejected are referred to as dynamic contact angles. As a measuring method of the dynamic contact angle, for example, (1) the Wilhelmy method, (2) the expansion/contraction method, and (3) the tilting plate method are known. Note that in the following measuring methods, a stainless steel plate with the same lyophobic film as the inside-nozzle lyophobic film formed thereon.

(1) In the Wilhelmy method, the weight of a solid sample is measured in both processes, a process of sinking the solid sample in a liquid sample contained in a sampling bath, and a process of pulling the solid sample out of the liquid sample, and the dynamic contact angles are obtained using the measured weights and the superficial area of the solid sample. The contact angle obtained in the sinking process is the advancing contact angle and the contact angle obtained in the process pulling process is the receding contact angle.

(2) In the expansion/contraction method, an advancing contact angle is obtained by measuring a contact angle between a surface of a solid sample and a drop of a liquid sample while forming the drop of the liquid sample on the solid sample by extruding the liquid sample from the tip of a needle or a grass capillary. A receding contact angle is obtained by measuring a contact angle between the surface of the solid sample and the drop of the liquid sample while sucking in the liquid sample forming the drop from the tip of the needle or the grass capillary.

(3) In the tilting plate method, a contact angle is measured while tilting a solid sample with a drop of a liquid sample formed thereon or setting the solid sample vertically to move the drop downward. The contact angle in the leading side in the moving direction of the drop is the advancing contact angle. The contact angle in the trailing side is the receding contact angle.

However, since the above methods have drawbacks, such as limitation of measurable samples, in the present exemplary embodiment the following measuring method that is a modification of (2) the expansion/contraction method.

Figure 3A:
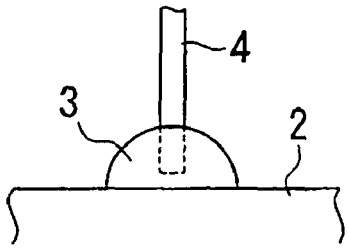
FIGS. 3(*a*) and (*b*) are schematics for explaining a measuring method of dynamic contact angles.
Figure 3B:
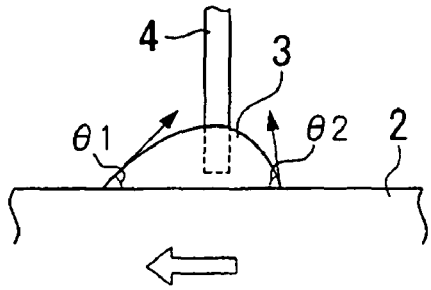

As shown in FIG. 3(*a*), a solid sample 2 is moved horizontally while the tip of a needle-like tube 4 enters a drop 3 formed on the solid sample 2. Since the needle-like tube 4 enters the drop 3, as shown in FIG. 3(*b*), the drop 3 is deformed so as to be dragged with the needle-like tube 4 due to the boundary tension between the drop 3 and the needle-like tube 4.

The amount of the contact angle between the solid sample 2 and the liquid sample 3 in the condition in which the drop 3 is thus deformed depends on the surface tension of liquid forming the drop 3, the surface tension of a solid material forming the solid sample 2, the boundary tension, frictional force, and adsorbability between the liquid and the solid material, surface roughness of the solid material, and so on, the dynamic contact angles can be obtained by measuring the contact angle in this condition. Specifically, the receding contact angle is obtained from the leading contact angle θ1 in the moving direction of the solid sample 2, and the advancing contact angle is obtained by the trailing contact angle θ2.

In the measuring method as described above, by horizontally moving the solid sample 2 with the tip of the needle-like tube inserted in the drop formed on the solid sample 2, the dynamic contact angle resulted therefrom can alone be measured without examining the above factors, such as surface energy or a friction force. Accordingly, the present exemplary embodiment adopts the measuring method as shown in FIG. 3 as a method of measuring the advancing contact angle and the receding contact angle. It is no doubt that the present invention can adopt other measuring method than the measuring method shown in FIG. 3, such as the above measuring method listed in (1) through (3). In those cases, there may be a tolerance between the dynamic contact angles (the advancing contact angle and the receding contact angle) measured by these methods due to, for example, the difference in measuring instruments (the instrumental error). Therefore, if another measuring method, other than the measuring method shown in FIG. 3, is used, it is desirable to correlate the measuring method with the measuring method shown in FIG. 3 and then to convert the measured value (the dynamic contact angle) into the value (the dynamic contact angle) to be obtained by the measuring method shown in FIG. 3.

Next, based on the method of forming the inside-nozzle lyophobic film shown in FIG. 2, a method of manufacturing an ink jet head and an ink jet head according to an exemplary embodiment of the present invention is described herein.

First Exemplary Embodiment

In an aspect of the present invention, firstly, the nozzle plate 12 provided with the nozzle 18 is provided. Note that the providing nozzle 18 of the nozzle plate 12 has the ejection opening 9 with the internal diameter of about 25 μm and a distance from the ejection opening 9 to the tapered section, namely the straight section, of about 25 μm.

Figure 4A:
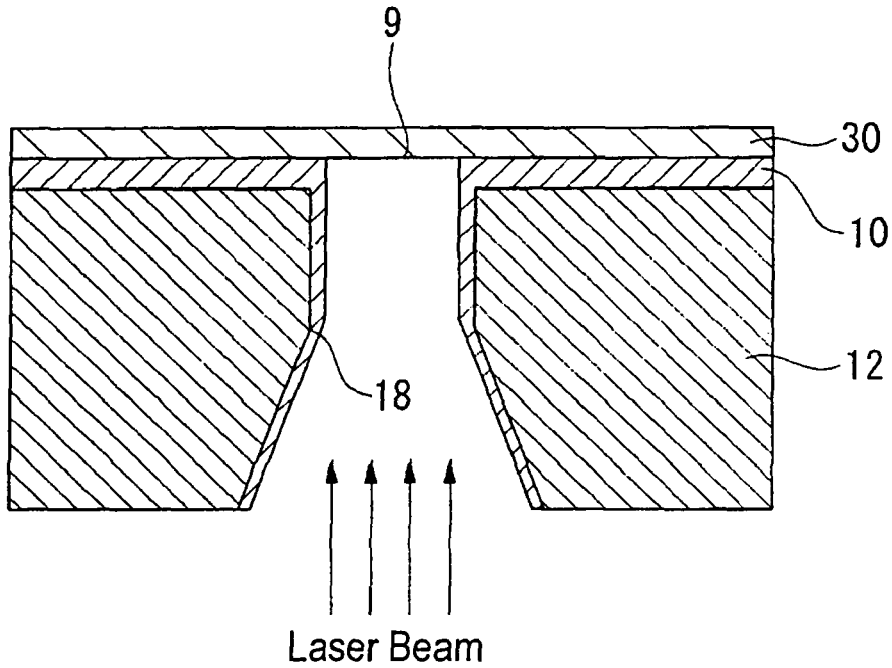
FIGS. 4(*a*) and (*b*) are cross-sectional schematics for explaining a first exemplary embodiment of the present invention.
Figure 4B:
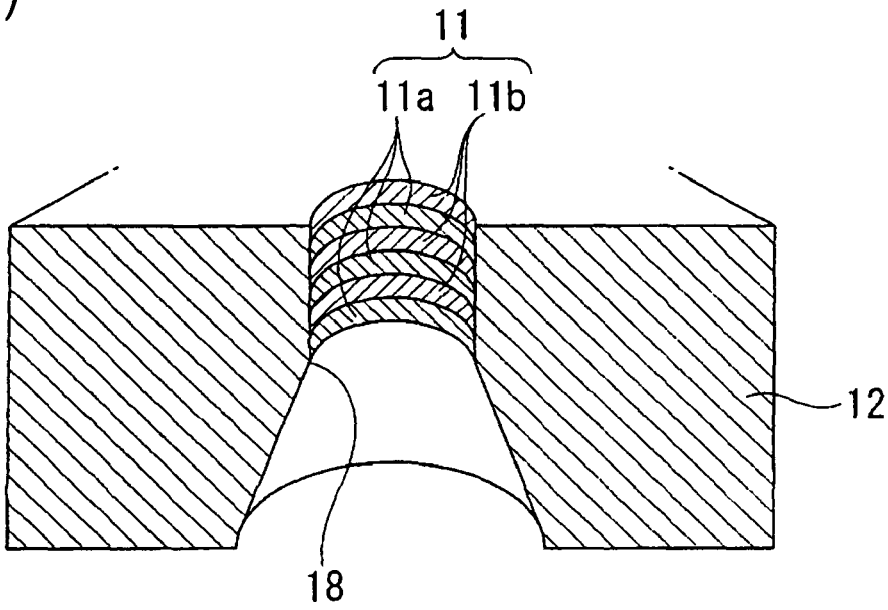
Figure 5:
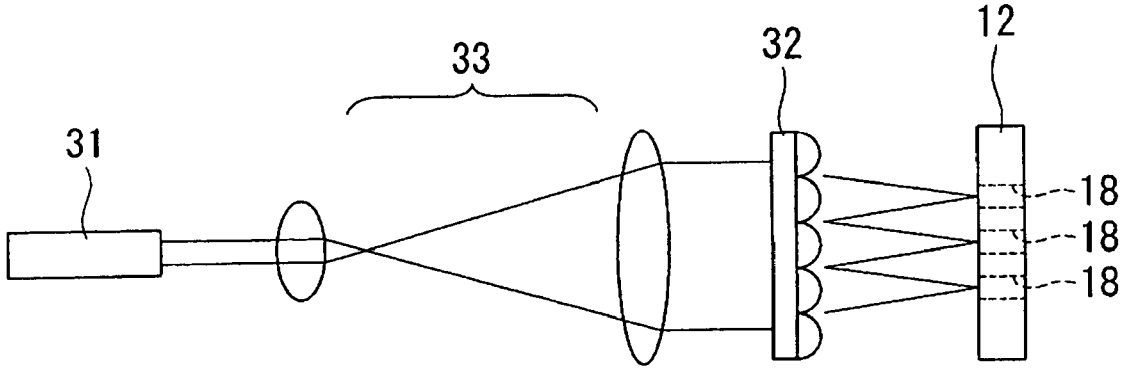
FIG. 5 is a schematic for explaining a modification of an exemplary embodiment of the present invention.

Succeedingly, silicone resin is plasma polymerized on the surface of the nozzle plate 12 with the ejection opening 9 provided, as shown in FIG. 4(*a*) to form the plasma-polymerized film of about 0.5 μm thick on the surface with the ejection opening 9. In this case, the plasma-polymerized film is formed so as to round into the ejection opening 9, and as shown in FIG. 4(*a*), the plasma-polymerized film can be provided on the inside wall of the nozzle 18 and in the vicinity of the ejection opening 9. Note that the thickness of the plasma-polymerized film formed on the inside wall of the nozzle 18 is, for example, about a few tens nm, which is far thinner than the plasma-polymerized film formed on the surface with the ejection opening 9.

By thus plasma-polymerized, the obtained plasma-polymerized film is provided with a principal chain comprising —Si— and a side chain of a carbon compound group, and thus forming a film having lyophobicity (hydrophobicity), specifically a lyophobic film 10.

After thus forming the lyophobic film 10 on the surface with the ejection opening 9 and inside the nozzle 18 and in the vicinity of the ejection opening 9, a reflecting mirror 30 is provided in the lyophobic film 10 side of the nozzle plate 12, specifically the ejection opening 9 side thereof so as to cover the ejection opening 9. A dielectric mirror may be used as the reflecting mirror 30 because of its high reflectivity in the target wavelength band.

After the reflecting mirror 30 is closely contacted to the lyophobic film 10 on the surface with ejection opening 9 so as to cover the ejection opening 9, in that condition, an excimer laser beam (the wavelength of 174 nm), the ultra violet laser beam, is input from a side of the nozzle plate 12 opposite to the ejection opening 9 under an oxygen environment (note that since oxygen absorbs the ultra violet beam to generate ozone, only small amount of oxygen is added to nitrogen) along the axis of the nozzle 18.

Then, in the nozzle 18, interference between the incident beam of the excimer laser beam and the reflecting beam of the reflecting mirror 30 occurs to generate the interference pattern. Since the plasma-polymerized film (the lyophobic film 10) is exposed to the interference pattern, the plasma-polymerization film is partially exposed. Ring shaped exposed sections and unexposed sections are alternately formed on the plasma-polymerized film in about 0.2 μm pitch by the interference pattern.

In the exposed sections, an alkyl group and an allyl group that are side chains in the plasma-polymerized film including silicone resin are destroyed by the excimer laser beam to finally form SiO2, that is hydrophilic (lyophilic) by acquiring oxygen from the environment. Accordingly, as shown in FIG. 4, in the nozzle 18, the exposed sections are provided with lyophilicity to form a lyophilic sections 11*a* by acquiring oxygen. Meanwhile, in the unexposed sections, the plasma-polymerized film is maintained as it is (lyophobic film 10), specifically a lyophobic sections 11*b*. Therefore, since the lyophilic sections 11*a* and the lyophobic sections 11*b* are alternately provided, the plasma-polymerized film in the nozzle 18 has a relatively large advancing contact angle and a small receding contact angle.

If the lyophilic sections 11*a* and the lyophobic sections 11*b* are alternately provided, when the fluid moves in the nozzle 18, the advancing contact angle is apt to become larger in the leading edge because the fluid stays mainly in the lyophobic sections 11*b* and moves faster on the lyophilic sections 11*a* positioned between the lyophobic sections 11*b*. In the trailing edge thereof, the receding contact angle is apt to become smaller because it is pulled by the lyophilic section 11*a*. Therefore, since the difference between the advancing contact angle and the receding contact angle becomes large, the film obtained after the exposure process can be the inside-nozzle lyophobic film 11 of an aspect of the present invention.

According to the method of manufacturing an ink jet head according to the present exemplary embodiment in which the inside-nozzle lyophobic film 11 is thus provided, the difference between the advancing contact angle and the receding contact angle of the inside-nozzle lyophobic film 11 can be larger by alternately forming the lyophilic sections and the lyophobic sections. Therefore, the obtained ink jet head, as described above, exercises good stability of ejection owing to the inside-nozzle lyophobic film.

Experimental Example

According to the first exemplary embodiment, the inside-nozzle lyophobic film 11 is formed on the nozzle plate 12. The advancing contact angle and the receding contact angle of the inside-nozzle lyophobic film 11 in the obtained nozzle plate 12 for the fluid are respectively measured by the method shown in FIGS. 3(*a*) and (*b*). As a result, the advancing contact angle is 60 degrees, and the receding contact angle is 20 degrees, making a difference of 40 degrees.

The fluid is ejected using the ink jet head having the nozzle plate 12 on which the inside-nozzle lyophobic film 11 is thus formed. As a result, it is confirmed that a tolerance of the weight of the ejected droplet, specifically tolerance of amount of ejection is sufficiently small. Accordingly the ink jet head with the inside-nozzle lyophobic film formed thereon exercises good stability of ejection.

Second Exemplary Embodiment

In the present exemplary embodiment, as is the case with the first exemplary embodiment, the nozzle plate 12 having a nozzle 18 formed thereon is provided. Note that the provided nozzle plate itself is the same as that in the first exemplary embodiment.

Consequently, the silicone resin is plasma-polymerized on the surface of the nozzle plate 12 on which the ejection opening 9 is provided to form a plasma-polymerized film of about 0.5 μm thick on the surface with ejection opening 9 formed thereon as is the case with the first exemplary embodiment. At this time, the plasma-polymerized film is formed so as to round into the ejection opening 9 of the nozzle 18, and the plasma-polymerized film is formed inside wall of the nozzle 18 in the vicinity of the ejection opening 9, the plasma-polymerized film forming the lyophobic film 10.

After thus forming the lyophobic film 10, a reflecting plate (not shown in the drawings) is provided in the lyophobic film 10 side of the nozzle plate 12, specifically the ejection opening 9 side so as to cover the ejection opening 9. As the reflecting plate, for example, an aluminum plate having a patterned indented surface as fine as the wavelength of the excimer laser beam (174 um) may be applied. As the indented pattern, for example, irregular mottling to cause the reflected beam to form a speckle pattern is adopted. Or, as the indented pattern, striped hologram (e.g., kinoform) to cause the reflected beam to focus on a predetermined position in the nozzle 18.

As described above, when the reflecting plate is closely contacted to the ejection opening 9 side of the lyophobic film 10 to cover the ejection opening 9, in the same manner as the previous exemplary embodiment, excimer laser beam (the wavelength of 174 nm) is input from the side opposite to the ejection opening 9 under the oxygen environment.

Then, the beam from the reflecting plate forms the speckle pattern by diffusedly reflected by the patterned indented surface. By being exposed to the speckle pattern, the plasma-polymerization film (lyophobic film 10) is irregularly exposed, thus forming the exposed sections. Specifically the lyophilic sections and unexposed sections, namely the lyophobic sections in an irregular manner.

Therefore, since the lyophilic sections 11*a* and the lyophobic sections 11*b* are irregularly provided, the plasma-polymerized film in the nozzle 18 has a relatively large advancing contact angle and a small receding contact angle. If the lyophilic sections 11*a* and the lyophobic sections 11*b* are irregularly provided, when the fluid moves in the nozzle 18, the advancing contact angle is apt to become larger in the leading edge because the fluid stays mainly in the lyophobic sections 11*b* and moves faster on the lyophilic sections 11*a* positioned between the lyophobic sections 11*b*. In contrast, in the trailing edge thereof, the receding contact angle is apt to become smaller because it is pulled by the lyophilic section 11*a*. Therefore, since the difference between the advancing contact angle and the receding contact angle becomes large, the film obtained after the exposure process can be the inside-nozzle lyophobic film 11 of an aspect of the present invention.

According to the method of manufacturing an ink jet head according to the present exemplary embodiment in which the inside-nozzle lyophobic film 11 is thus provided, the difference between the advancing contact angle and the receding contact angle of the inside-nozzle lyophobic film 11 can be larger by irregularly forming the lyophilic sections and the lyophobic sections. Therefore, the obtained ink jet head, as described above, exercises good stability of ejection owing to the inside-nozzle lyophobic film.

Third Exemplary Embodiment

In the present exemplary embodiment, as is the case with the first exemplary embodiment, the nozzle plate 12 having a nozzle 18 formed thereon is provided. Note that the provided nozzle plate itself is the same as that in the first exemplary embodiment.

Consequently, the silicone resin is plasma-polymerized on the surface of the nozzle plate 12 on which the ejection opening 9 is provided to form a plasma-polymerized film of about 0.5 μm thick on the surface with ejection opening 9 formed thereon as is the case with the first exemplary embodiment. At this time, the plasma-polymerized film is formed so as to round into the ejection opening 9 of the nozzle 18. The plasma-polymerized film is formed inside wall of the nozzle 18 in the vicinity of the ejection opening 9, the plasma-polymerized film forming the lyophobic film 10.

After thus forming the lyophobic film 10 formed of the plasma-polymerized film, in the condition as it is without using the reflection mirror or reflection plate, an ultra short pulsed laser beam (femtosecond laser) is input from the side opposite to the ejection opening 9 under the oxygen environment along the axis of the nozzle 18.

In this case, since the plasma-polymerized film (the lyophobic film 10) is exposed at a moment with large energy, it is irregularly exposed to be, for example, a striped pattern. And thus, the exposed sections, specifically the lyophilic sections and unexposed sections, namely the lyophobic sections are formed irregularly.

Therefore, since the lyophilic sections 11*a* and the lyophobic sections 11*b* are irregularly provided, the plasma-polymerized film in the nozzle 18 has a relatively large advancing contact angle and a small receding contact angle. Therefore, since the difference between the advancing contact angle and the receding contact angle becomes large, the film obtained after the exposure process can be the inside-nozzle lyophobic film 11 of an aspect of the present invention.

According to the method of manufacturing an ink jet head according to the present exemplary embodiment in which the inside-nozzle lyophobic film 11 is thus provided, the difference between the advancing contact angle and the receding contact angle of the inside-nozzle lyophobic film 11 can be larger by irregularly forming the lyophilic sections and the lyophobic sections. Therefore, the obtained ink jet head, as described above, exercises good stability of ejection owing to the inside-nozzle lyophobic film.

Note that the present invention is not limited to the exemplary embodiments described above, but can be modified in various ways within the scope or the spirit of the present invention. For example, in the above exemplary embodiment, when inputting the laser beam to the nozzle 18 of the nozzle plate 12, by disposing a lens array (condensers) 32 between the laser beam source 31 and the nozzle plate 12, the laser beam can be focused inside the nozzle 18 of the nozzle plate 12 via the lens array 32. Specifically, a laser beam output from the laser beam source 31 and then collimated by optical lens system 33 is input to the lens array 32 as a parallel beam, which can be focused on each of the nozzles 18 of the nozzle plate 12 by the lens array 32.

In this structure, by focusing the laser beam inside the nozzle by the lens array 32, exposure efficiency can be enhanced to, for example, reduce the exposure time or increase the exposure value.

Furthermore, it is also possible to apply energy to the lyophobic film without any energy distributions while moving continuously or intermittently the energy application position to form the lyophobic sections and the lyophilic sections. Specifically, by irradiating the lyophobic film with low-powered ultra short pulsed laser focused on a micro mirror (e.g., 5 μm square) while moving the angle of the micro mirror, the lyophobic sections and the lyophilic sections can be patterned in the nozzle.

By thus configured, since the lyophobic sections and the lyophilic sections are mixed, the inside-nozzle lyophobic film has a relatively large advancing contact angle and a small receding contact angle for the target fluid. Therefore, the difference between the advancing and the receding contact angles can be made larger to exercise good stability of ejection resulting in the stable amount of ejection.

What is claimed is:

1. An ink jet head, comprising:

a nozzle; and a film formed on an inside wall of the nozzle, the film having a plurality of lyophobic sections and a plurality of lyophilic sections, wherein the lyophobic sections and the lyophilic sections are alternately distributed.

2. The ink jet head according to claim 1, the lyophobic sections and lyophilic sections being disposed on the inside wall of the nozzle.

3. The ink jet head according to claim 1, comprising:

a nozzle plate having the nozzle, the film being formed on the surface of the nozzle plate.

4. The ink jet head according to claim 3, the film having the lyophobic section in the surface of the nozzle plate.

5. An ink jet head, comprising:

a nozzle; and an inside-nozzle lyophobic film formed on an inside wall of the nozzle, the inside-nozzle lyophobic film providing a difference of 20 degrees or above between an advancing contact angle and a receding contact angle for a fluid to be ejected.

* * * * *